US005346093A

United States Patent [19]

De Benedittis et al.

[11] Patent Number: 5,346,093

[45] Date of Patent: Sep. 13, 1994

[54] LIQUID STORAGE SYSTEM

[75] Inventors: Louis De Benedittis, Nesconset, N.Y.; Charles A. Frey, Sr., Lancaster, Pa.

[73] Assignee: Areo-Power Unitized Fueler Company, Inc., Smithtown, N.Y.

[21] Appl. No.: 188,830

[22] Filed: Jan. 28, 1994

[51] Int. Cl.[5] ..... B65D 25/18

[52] U.S. Cl. ..... 220/565; 220/465; 220/4.12

[58] Field of Search ..... 220/571, 565, 465, 469, 220/4.12

[56] References Cited

U.S. PATENT DOCUMENTS 4,685,585 8/1987 Robbins ..... 220/4.12 X
4,895,272 1/1990 De Benedittis et al. ..... 220/565 X
4,986,436 1/1991 Bambacigno et al. ..... 220/565 X

*Primary Examiner*—Steven M. Pollard
*Attorney, Agent, or Firm*—Hartman Underhill & Brubaker

[57] ABSTRACT

This invention relates to an improvement in an above-ground storage system for volatile liquids wherein there is a horizontally extending cylindrical storage tank located in a dike, the tank having a top vent through which liquid may escape; the vent being surrounded by a collar and top cover to form a chamber around the vent and the collar having an outlet to drainage means down into the dike; the improvement comprising a weir so positioned in the collar that a limited overflow of liquid from the tank through the vent is retained by the weir within the collar at the top of the tank and escaping to the dike only when the capacity of the weir is exceeded.

6 Claims, 2 Drawing Sheets

LIQUID STORAGE SYSTEM

FIELD OF THE INVENTION

The present invention relates to above-ground liquid storage systems for volatile liquids and more particularly to an improvement in the system disclosed in U.S. Pat. No. 4,895,272.

BACKGROUND OF THE INVENTION

Although fuel is often stored in underground tanks, such as tanks at gas stations, there are situations where it is preferred to store flammable liquids such as aviation fuel in above-ground tanks. Whether the fuel storage is below or above ground, there are environmental and safety considerations.

In below-ground tanks, dual-walled pipe systems have been developed whereby if a pipe leaks between the storage tank and the dispenser, the leakage is captured and not allowed to seep into the ground. In U.S. Pat. No. 4,895,272 this is taken care of by the provision of a containment dike below the storage tank to receive liquid if the tank leaks or overflows. Discharge of the volatile liquid onto the ground is prevented.

When the tank system is above ground, the fuel in the tank will expand and contract depending on the temperature of the air around the tank. A vent is provided at the top of the tank to allow for changes in the air space at the top of the tank between the surface of the liquid and a vent.

To accommodate fuel expansion, a tank should not be filled to the top. It should be filled to a prescribed point and then the filling should be stopped. However, when an operator fills the tank it is sometimes filled beyond the desired level. The fuel does not overflow; but the airspace at the top of the tank is less than desired or required. Then when the fuel expands on a hot day, for example, some of the fuel may escape through the vent, overflow, and pass from the tank down into the containment dike. The overflow does not drop onto the ground because it is prevented from doing so by the dike. However, the dike becomes contaminated with fuel, the fuel spreading out over the floor of the dike. There is the smell of gasoline until the liquid evaporates.

One object of this prevention is to provide a chamber around the vent at the top of a tank positioned in a containment dike, means being provided whereby when a small amount of fuel overflows the vent, it is retained at the vent and does not flow down into the dike.

Another object in the invention is to form a small chamber within the collar around the vent at the top of the tank having means positioned to block the flow of fuel escaping from the vent to a downwardly extending passage along the side of the tank into the dike.

Another object of this invention is to provide a simple low cost liquid control design around the vent at the top of a tank that utilizes the surface of the tank and the collar around the vent as part of the overflow liquid holding structure.

A further object of this invention is to provide a first overflow chamber at a vent at the top of a tank and a second larger overflow chamber in a containment dike, fuel overflowing said tank being able to reach the dike only after it exceeds the capacity of the first and second holding chambers.

Other objects of this invention will be apparent hereinafter from the specification and from the recital in the appended claims.

DESCRIPTION OF PREFERRED EMBODIMENT

Figure 1:
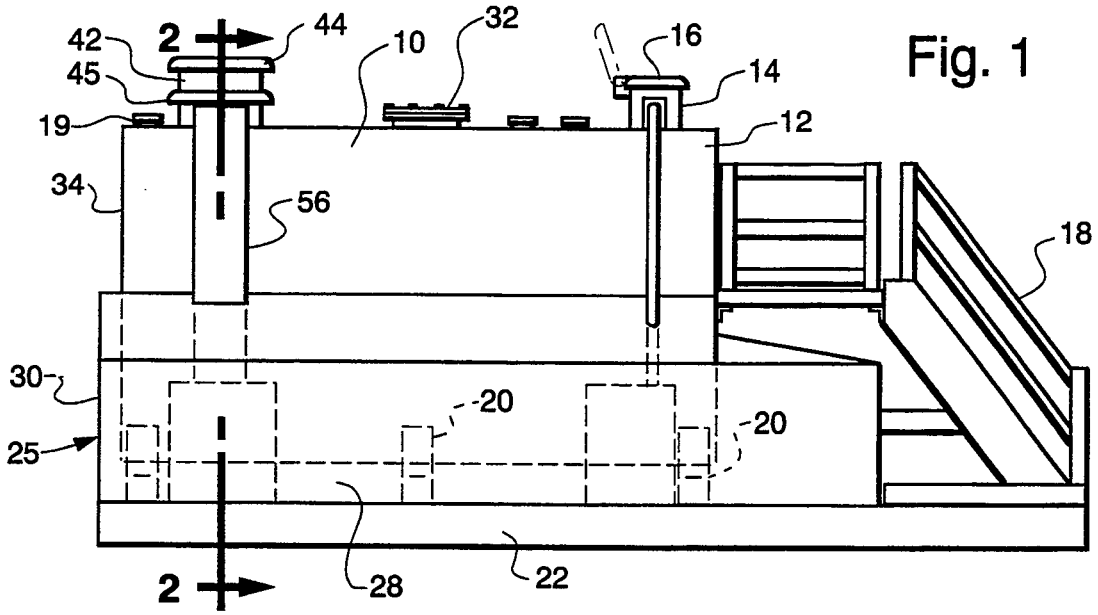
FIG. 1 is a side view of an above-ground liquid storage system wherein there is a horizontal cylindrical tank located in a containment dike beneath it, the tank having a vent at the top surrounded by a collar and cover in which means is located to prevent a small overflow of liquid from the tank to the dike.

Referring to the drawings by numerals of reference and first to FIG. 1, 10 denotes a cylindrical horizontally extending storage tank for volatile liquid fuels. The capacity of the tank can be of any desired size ranging for example, from 2000 gallons to 20,000 gallons.

At one end 12 of tank 10 there is a fill point 14 closed by a cover 16 adapted to be pivoted to an open position, FIG. 1. A stairway 18 is constructed into the system whereby easy access to tank 10 is provided for filling purposes. A fill gauge is shown at 19.

Tank 10 is supported by steel support cradles 20 carried on a frame 22 which rests on the ground or other supporting surface. The number of supports 20 will depend upon the length and capacity of tank 10.

Figure 2:
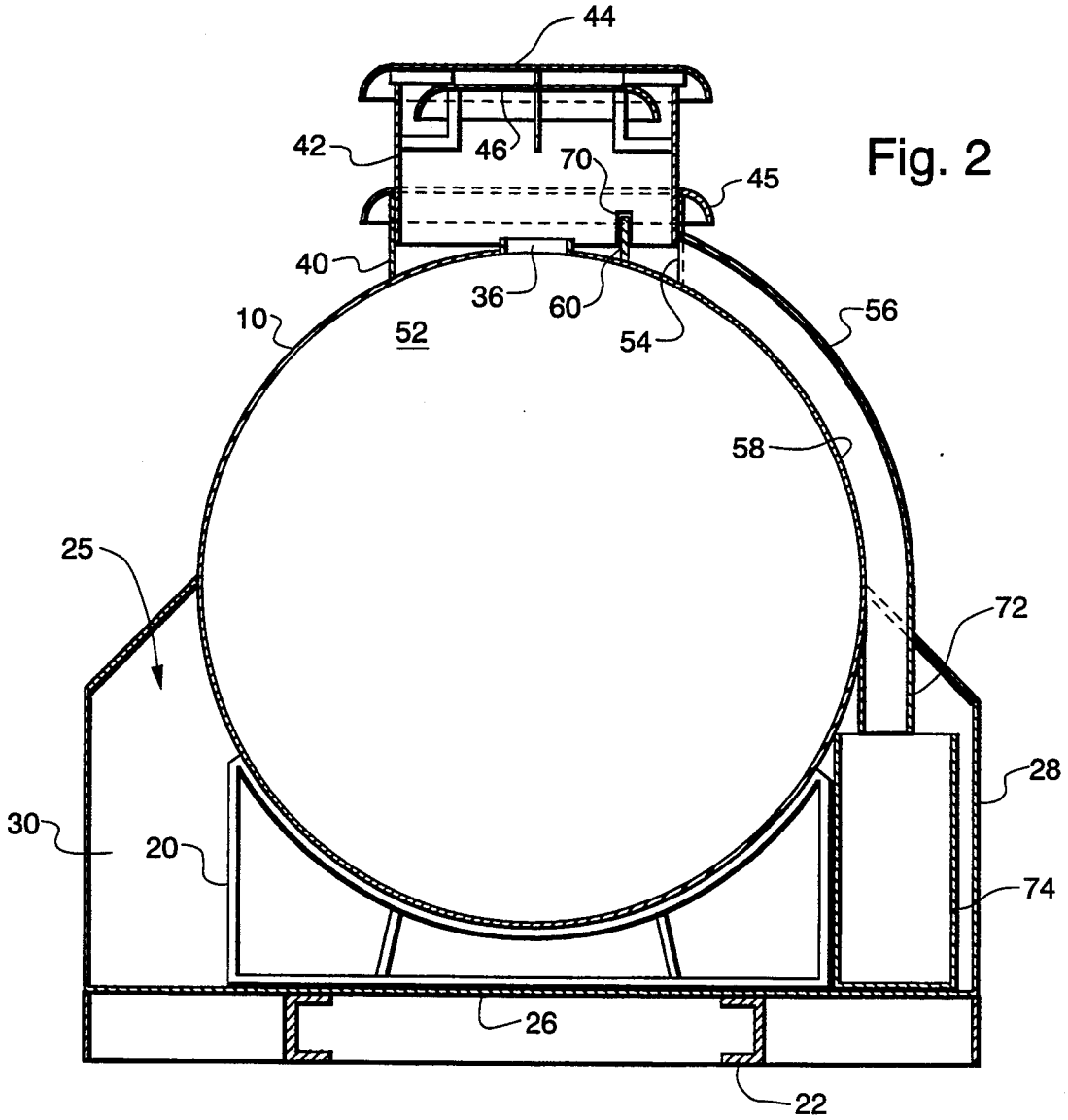
FIG. 2 is an enlarged vertical section taken generally on line 2—2 of FIG. 1 looking in the direction of the arrows.

Beneath tank 10 a containment dike 25 is provided having a horizontal floor 26 FIG. 2 and vertical side plates 28. The dike has end plates 30 which with the floor 26 and sides 28 form a containment space having a capacity greater than the capacity of tank 10. For example, if the tank has a capacity of 10,000 gallons, the safety containment structure could have 11,000 gallons of capacity. Therefore, if tank 10 ruptures, the fuel will escape downwardly into the containment vessel and be held there rather than being discharged onto the ground.

The axis of tank 10 is horizontal. At the upper center of the tank there is a manhole 32 through which access to the interior of the tank can be had for cleaning, repair and the like. Near the end 34 of tank 10 opposite stairway 18 there is an outlet vent 36 located in a plane through the vertical center of the tank.

Figure 3:
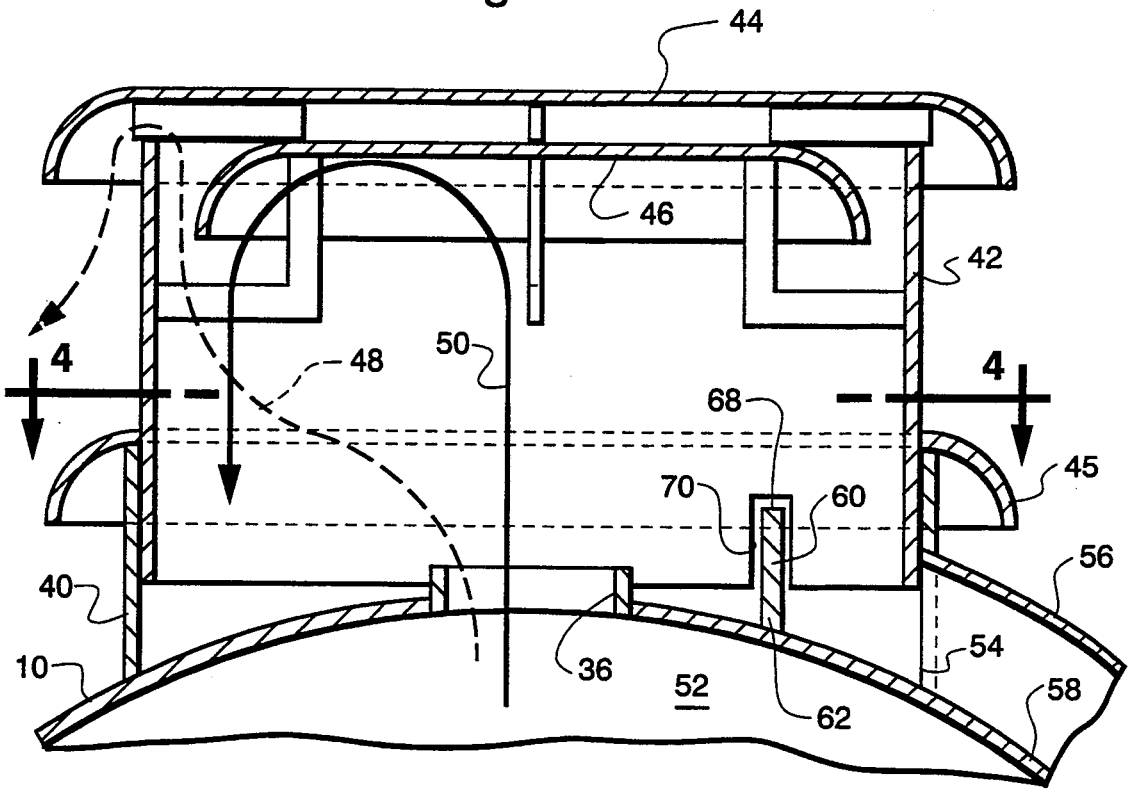
FIG. 3 is an enlarged view of the vent opening at the top of the tank and the surrounding collar and cover, having therein a weir to dam the overflow of fuel and to limit the point at which the fuel can escape through drainage means extending downwardly to the containment dike.
Figure 4:
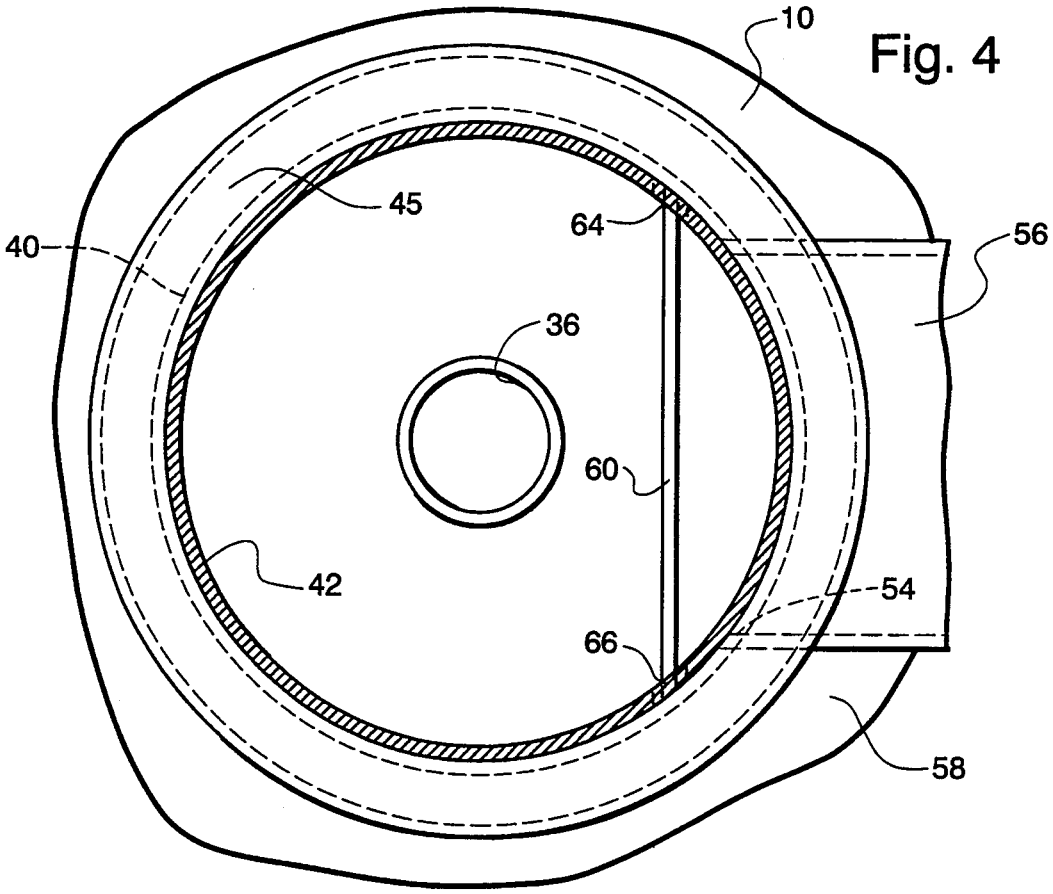
FIG. 4 is a section taken on the line 4—4 of FIG. 3 looking in the direction of the arrows.

As shown in FIGS. 2–4, vent 36 is surrounded by a collar 40 into which is fitted the neck 42 of a cover 44. Neck 42 has a deflector 45. Beneath cover 44 is a splashguard 46 having a diameter less than the diameter of the cover. Air escaping from tank 10 passes into the neck 42 and escapes into the atmosphere as shown by the dotted line 48. If fuel is ejected through vent 36 and spurts upwardly, it comes engagement with the splash plate 46 and is directed back downwardly as indicated by the solid line arrow 50 in FIG. 3.

Tank 10 is intended to be filled to a point below the top of the tank and less than its full capacity. This provides an airspace 52 at the top of the tank to allow for expansion and contraction of the fuel depending upon atmospheric conditions. However, if the person filling the tank inadvertently provides fuel beyond the prescribed level, the airspace will be too small. Subsequently, if the outside air is hot, the fuel might expand and some of it might escape through vent 36 and into the chamber provided by the collar 40.

At one point around the circumference of collar 40, an outlet 54 is provided which communicates with a downwardly extending drainage guide 56. Fuel escaping through the outlet 54 will pass on the outer surface 58 of the tank and within the guide 56 for discharge downwardly into the dike 25.

At times, the amount of fuel escaping through the vent 36 may be relatively small. It is desirable to maintain a small discharge at the top of the tank around the vent rather than let it flow through the outlet 54 and down into the dike. A small discharge on entering the dike can spread out on the floor and create an undesirable gasoline smell around the storage system. If the small discharge is maintained in a confined space at the top of the tank at outlet vent 36, the gasoline that escapes is held within the cover structure around the vent where in due course it can evaporate.

As provided by this invention, a weir plate 60 is provided in the collar 40 and located between vent 36 and outlet 54. Weir 60 extends in a vertical plane, having a lower end 62 welded to the surface of the tank 10 and having ends 64 and 66 welded to the inside of collar 40. The upper edge 68 of the weir extends horizontally parallel to the axis of the tank and terminating in a vertical location to establish the point where fuel can overflow the weir and exit from the top of the tank through outlet 54. Edge 68 is below the top edge of collar 40.

As shown in FIG. 3, the neck 42 of cover 44 is notched at 70 in two locations so that when the cover is placed on top of tank 10, the neck fits into collar 40 and the slots 70 are brought into register with weir 60 to allow the cover to be pressed down into place. Deflector 45 on neck 42 of cover 44 limits the downward movement of neck 42 into collar 40 and spaces the neck from the top edge 68 of weir 60.

With this design, a small discharge of fuel through vent 36 is trapped at the top of the tank where it will not overflow until the amount exceeds the liquid holding capacity established by the top edge 68 of weir 60.

If the discharge of fuel through vent 36 is substantial and there is a flow over from the weir, the fuel passes through guide 56 for discharge at 72 (FIG. 2) into a secondary vessel 74 of such size to receive a gallon or two of fuel before it is full. Fuel will spill over onto the floor 26 of the dike 25 only when the discharge of fuel through the vent 36 exceeds the combined capacity of weir 60 and the container 64.

Under normal circumstances, with an appropriately filled tank 10, fuel will not escape through vent 36; or if there is a minor discharge it will not overflow weir 60. If there is an overflow which exceeds the capacity of the chamber formed by weir 60, fuel will flow down into secondary container 74. Contamination of the dike 25 will not result. However, if there is a major expansion of the fuel in the tank 10 caused by a fire, for example, where the overflow is substantial, then the dike 25 will receive and hold fuel coming from tank 10. Regardless of the situation, fuel will not escape the system and be discharged onto the ground.

Although this invention has been described in connection with a particular design and embodiment thereof, it will be understood that it is capable of modification to achieve the objectives of his arrangement without departing from the concept disclosed.

Having thus described our invention, what we claim is:

1. In an above-ground storage system for holding volatile liquids where there is an internal storage tank having a longitudinal axis extending in a horizontal direction, an external containment dike structure beneath said tank and in which the tank is located, a vent at the top of the tank through which liquids may escape from the interior of the tank, drainage means for carrying liquids from said vent downwardly into said dike, and means for controlling the flow of liquid from said vent to said dike comprising:

a collar mounted on the tank and surrounding said vent;

said collar having an outlet communicating with said drainage means;

a weir mounted in said collar between said vent and said outlet and forming with the collar a chamber adapted to receive and hold a limited overflow of liquid from the tank;

said weir being connected to an outer surface of the tank and having ends connected to the inside of said collar;

a cover over and spaced vertically above said vent;

a neck extending downwardly from the cover and fitted into said collar;

and said weir having an upper edge over which liquid may flow when the capacity of said chamber in said collar is exceeded for discharge through said outlet and into said drainage means.

2. In an above-ground storage system as recited in claim 1 wherein said weir comprises a vertically extending plate spaced laterally from said tank vent and from said collar outlet, said tank being generally cylindrical and said weir extending lengthwise of the tank parallel to the longitudinal axis of the tank.

3. In an above-ground storage system as recited in claim 2 wherein said neck extends downwardly beyond said upper edge of said weir, the neck having notches to receive the weir.

4. In an above-ground storage system as recited in claim 3, wherein said neck carries an outwardly projecting deflector positioned to engage a top edge of said collar when the neck is fitted into the collar and limiting the downward penetration of the neck into the collar and maintaining the neck spaced from said weir.

5. In an above-ground storage system as recited in claim 1 wherein a secondary container is provided in said dike and located to receive liquid discharged from said drainage means.

6. In an above-ground storage system as recited in claim 5 wherein the damming capacity of said chamber provided by said weir is less than the capacity of said secondary container, and the capacity of the container is less than the capacity of said dike, liquid entering the dike only when the container overflows.

* * * * *